US011585559B2

(12) United States Patent
Jiao et al.

(10) Patent No.: US 11,585,559 B2
(45) Date of Patent: Feb. 21, 2023

(54) METHOD AND SYSTEM OF CONTROLLING OPERATION STATE OF MULTI-SPLIT AIR CONDITIONER, AND HEAT PUMP MULTI-SPLIT AIR CONDITIONER

(71) Applicants: Gree Electric Appliances (Wuhan) Co., Ltd., Wuhan (CN); Gree Electric Appliances, Inc. of Zhuhai, Zhuhai (CN)

(72) Inventors: Huachao Jiao, Zhuhai (CN); Jianguo Xiong, Zhuhai (CN); Shiqiang Zhang, Zhuhai (CN); Lianfa Wu, Zhuhai (CN); Bing Zhou, Zhuhai (CN); Zhiguang Huang, Zhuhai (CN); Donghui Li, Zhuhai (CN); Bo Qiu, Zhuhai (CN)

(73) Assignees: Gree Electric Appliances (Wuhan) Co., Ltd., Hubei (CN); Gree Electric Appliances, Inc. of Zhuhai, Guangdong (CN)

( * ) Notice: Subject to any disclaimer, the term of this patent is extended or adjusted under 35 U.S.C. 154(b) by 509 days.

(21) Appl. No.: 16/649,820

(22) PCT Filed: Sep. 12, 2018

(86) PCT No.: PCT/CN2018/105135
§ 371 (c)(1),
(2) Date: Mar. 23, 2020

(87) PCT Pub. No.: WO2019/056966
PCT Pub. Date: Mar. 28, 2019

(65) Prior Publication Data

US 2020/0284461 A1 Sep. 10, 2020

(30) Foreign Application Priority Data

Sep. 25, 2017 (CN) ..... 201710874193.7

(51) Int. Cl.
*F24F 11/67* (2018.01)
*F24F 11/66* (2018.01)
(Continued)

(52) U.S. Cl.
CPC ..... *F24F 11/67* (2018.01); *F24F 1/0003* (2013.01); *F24F 1/0018* (2013.01);
(Continued)

(58) Field of Classification Search
None
See application file for complete search history.

(56) References Cited

U.S. PATENT DOCUMENTS 8,655,492 B2 2/2014 Wakuta et al.
2004/0134214 A1* 7/2004 Song ..... F25B 13/00 62/199
(Continued)

FOREIGN PATENT DOCUMENTS

CN 1517625 A 8/2004
CN 104482633 A 4/2015
(Continued)

*Primary Examiner* — Nathan L Laughlin
(74) *Attorney, Agent, or Firm* — The Webb Law Firm

(57) ABSTRACT

The present disclosure relates to a method of controlling operation state of multi-split air conditioner and system, and a heat pump multi-split. The control method includes: determining a target operation mode of each indoor unit according to an operation mode set by a user for the indoor unit; performing statistics on heat exchange demands of the indoor units corresponding to different target operation modes, and determining a dominant operation mode among the target operation modes according to the heat exchange demands; and using the dominant operation mode as the operation mode of an outdoor unit.

19 Claims, 2 Drawing Sheets

(51) Int. Cl.

| | |
|---|---|
| ***F24F 11/64*** | (2018.01) |
| ***F24F 1/0083*** | (2019.01) |
| ***F24F 1/0003*** | (2019.01) |
| ***F24F 1/0018*** | (2019.01) |
| *F24F 110/10* | (2018.01) |

(52) U.S. Cl.
CPC ..... *F24F 1/0083* (2019.02); *F24F 11/64* (2018.01); *F24F 11/66* (2018.01); *F24F 2110/10* (2018.01)

(56) References Cited

U.S. PATENT DOCUMENTS

| | | | | |
|---|---|---|---|---|
| 2004/0138784 | A1 | 7/2004 | Park et al. | |
| 2006/0086103 | A1* | 4/2006 | Lee | F25B 49/005 62/126 |
| 2008/0178615 | A1 | 7/2008 | Yoon et al. | |
| 2011/0093121 | A1 | 4/2011 | Wakuta et al. | |
| 2016/0363335 | A1 | 12/2016 | Xiong et al. | |
| 2019/0056139 | A1* | 2/2019 | Bu | F24F 11/30 |

FOREIGN PATENT DOCUMENTS

| | | | | | |
|---|---|---|---|---|---|
| CN | 104879899 | A | | 9/2015 | |
| CN | 105674402 | A | | 6/2016 | |
| CN | 106403183 | A | | 2/2017 | |
| CN | 106642521 | A | | 5/2017 | |
| CN | 107560092 | A | | 1/2018 | |
| EP | 1643195 | A2 | | 4/2006 | |
| JP | H0914790 | A | | 1/1997 | |
| JP | 2955278 | B2 | | 10/1999 | |
| JP | 2012193952 | A | | 10/2012 | |
| JP | 2014102053 | A | | 6/2014 | |
| JP | PG2014102053 | | * | 6/2014 | F24F 11/02 |
| JP | 5737173 | B2 | | 6/2015 | |
| KR | 100795602 | B1 | | 1/2008 | |
| KR | 1020120094305 | A | | 8/2012 | |

* cited by examiner

METHOD AND SYSTEM OF CONTROLLING OPERATION STATE OF MULTI-SPLIT AIR CONDITIONER, AND HEAT PUMP MULTI-SPLIT AIR CONDITIONER

CROSS-REFERENCE TO RELATED APPLICATIONS

This application is the United States national phase of International Application No. PCT/CN2018/105135 filed Sep. 12, 2018, and claims priority to Chinese Patent Application No. 201710874193.7 filed Sep. 25, 2017, the disclosures of which are hereby incorporated by reference in their entirety.

FIELD OF THE DISCLOSURE

The present disclosure relates to the technical field of air conditioners, and in particular, to a method and system of controlling operation state of multi-split air conditioner, and a heat pump multi-split air conditioner.

BACKGROUND OF THE DISCLOSURE

A multi-split system refers to an air conditioning system in which one or more outdoor units are connected to a plurality of indoor units. A heat pump multi-split can operate a refrigeration mode or a heating mode, but the indoor units cannot run a mode whichconflicts with the outdoor unit.

At present, an operation mode of most of the outdoor unit are determined by a main indoor unit mode in the multi-split system, but this judgment mode method is not free and democratic enough, and it is easy to cause user complaints in public places such as office buildings.

To this end, another control method for presetting a preferential operation mode has appeared in the prior art. When a user has special demands for refrigeration, for example, in a hot summer, the refrigeration mode may be set as a preferential mode, the outdoor unit preferentially operates the indoor unit that selects the refrigeration mode when receiving different mode selections of a plurality of indoor units, and the other indoor units do not operate. By setting the preferential operation mode, the control mode may avoid the abnormality of air conditioning operation due to selection mode conflict or erroneous operation, thereby improving the use convenience of the user, but since the preferential operation mode is preset according to demands, it does not reflect the actual use demands of all users, so the control mode still lacks freedom and democracy in use, and may also cause some complaints when used in office buildings and other places.

SUMMARY OF THE DISCLOSURE

According to a first aspect of the present disclosure, a method of controlling operation state of multi-split air conditioner is provided, including:

determining a target operation mode of each indoor unit according to an operation mode set by a user for the indoor unit;

performing statistics on heat exchange demands of the indoor units corresponding to different target operation modes, and determining a dominant operation mode among the target operation modes according to the heat exchange demands; and using the dominant operation mode as the operation mode of an outdoor unit.

In some embodiments, after determining the operation mode of the outdoor unit, the control method In some embodiments includes:

judging whether the target operation mode of the indoor unit is consistent with the operation mode of the outdoor unit, if so, determining a final operation state of the indoor unit according to the target operation mode of the indoor unit, if no, determining the final operation state of the indoor unit according to a predetermined conflict resolution rule.

In some embodiments, the step of determining the target operation modes of each indoor unit according to the operation mode set by the user for the indoor unit specifically includes at least one of the following steps:

if the operation mode set for the indoor unit is a refrigeration mode or a dehumidification mode, determining the target operation mode of the indoor unit as the refrigeration mode;

if the operation mode set for the indoor unit is a heating mode, determining the target operation mode of the indoor unit as the heating mode;

if the operation mode set for the indoor unit is an air supply mode, determining the target operation mode of the indoor unit as the air supply mode; and/or if the operation mode set for the indoor unit is an automatic mode, determining the target operation mode of the indoor unit according to a current environment temperature and a temperature range in the automatic mode set by the user.

In some embodiments, if the operation mode set for the indoor unit is the automatic mode, the step of determining the target operation mode of the indoor unit according to the current environment temperature and the temperature range in the automatic mode set by the user, specifically includes at least one of the following steps:

if the current environment temperature is greater than an upper limit of the temperature range, determining the target operation mode of the indoor unit as the refrigeration mode;

if the current environment temperature is less than the upper limit of the temperature range, determining the target operation mode of the indoor unit as the heating mode; and if the current environment temperature is within the temperature range, maintaining the target operation mode of the indoor unit as the previous target operation mode within the temperature range, or performing processing according to a default mode when entering the temperature range for the first time.

In some embodiments, the step of performing statistics on heat exchange demands of the indoor units corresponding to different target operation modes specifically includes:

performing statistics on the number or capacity of the indoor units corresponding to different target operation modes to serve as the heat exchange demands.

In some embodiments, the step of performing statistics on heat exchange demands of the indoor units corresponding to different target operation modes, and determining the dominant operation mode among the target operation modes according to the heat exchange demands, specifically includes:

performing statistics on heat exchange demand of the indoor units having the refrigeration mode as the target operation mode and heat exchange demand of the indoor units having the heating mode as the target operation modes; and comparing the heat exchange demand of the indoor units having the refrigeration mode as the target operation and heat exchange demand of the indoor units having the heating mode as the target operation mode, and if the heat exchange demand of the indoor unit in the refrigeration mode is greater than the heat exchange demand of the indoor units in the heating mode, determining the dominant operation mode of each indoor unit as the heating mode; if the heat exchange demand of the indoor units in the refrigeration mode is less than the heat exchange demand of the indoor units in the heating mode, determining the dominant operation mode of each indoor unit as the heating mode; and if the heat exchange demand of the indoor unit in the refrigeration mode is equal to the heat exchange demand of the indoor units in the heating mode, maintaining the dominant operation mode of each indoor unit unchanged, or performing processing according to a default mode when the dominant operation mode is determined for the first time.

In some embodiments, the step of determining the final operation state of the indoor unit according to the predetermined conflict resolution rule includes: causing the indoor unit in which the target operation mode is inconsistent with the operation mode of the outdoor unit to enter a standby mode.

In some embodiments, the step of determining the final operation state of the indoor unit according to the predetermined conflict resolution rule includes:

causing the indoor unit in which the target operation mode is inconsistent with the operation mode of the outdoor unit to enter the same operation mode as the outdoor unit's.

In some embodiments, when the indoor unit in which the target operation mode is inconsistent with the operation mode of the outdoor unit enter the same operation mode as the outdoor unit's, a low-energy heat exchange mode is adopted for operation.

In some embodiments, the low-energy heat exchange mode includes:

a low-energy refrigeration mode: a draught fan of the indoor unit operates at a low wind speed, and a target degree of superheat controlled by an electronic expansion valve of the indoor unit is increased by a first preset temperature value compared with that of a normal refrigeration mode; or a low-energy heating mode: the draught fan of the indoor unit operates at the low wind speed, and a target degree of supercooling controlled by the electronic expansion valve of the indoor unit is increased by a second preset temperature value compared with that of a normal heating mode.

In some embodiments, in the low-energy heat exchange mode, when the outdoor unit calculates the heat exchange capacity demand of the current indoor unit, a preset coefficient m is multiplied by the normal heat exchange capacity of the indoor unit, wherein $0<m<1$.

In some embodiments, in the low-energy heat exchange mode, the indoor unit is adjusted with a temperature set by the user as a target.

In some embodiments, the target operation mode of the indoor unit has a preset memory time, and after exceeding the preset memory time, the target operation mode of the indoor unit is replaced with the operation mode of the outdoor unit.

In some embodiments, within the preset memory time, if the user resets the operation mode of the indoor unit, the indoor unit re-determines the target operation mode, and accumulates the preset memory time again starting from the reset moment.

In some embodiments, within the preset memory time, if the target operation mode of the indoor unit is consistent with the operation mode of the outdoor unit, the indoor unit adopts the target operation mode, and if the target operation mode of the indoor unit is inconsistent with the operation mode of the outdoor unit, the indoor unit works according to the operation mode of the outdoor unit in the low-energy heat exchange mode.

According to a second aspect of the present disclosure, a system of controlling operation state of multi-split air conditioner is provided, including:

a target operation mode determining module, configured to determine a target operation mode of each indoor unit according to an operation mode set by a user for the indoor unit;

a dominant operation mode determining module, configured to perform statistics on heat exchange demands of the indoor units corresponding to different target operation modes, and determine a dominant operation mode among the target operation modes according to the heat exchange demands; and an outdoor unit operation mode determining module, configured to determine the dominant operation mode determined by the dominant operation mode determining module as the operation mode of an outdoor unit.

In some embodiments, the control system further includes an indoor unit operation state determining module, configured to judge whether the target operation mode of the indoor unit determined by the target operation mode determining module is consistent with the operation mode of the outdoor unit determined by the outdoor unit operation mode determining module, if yes, determine a final operation state of the indoor unit according to the target operation mode of the indoor unit, if no, determine the final operation state of the indoor unit according to a predetermined conflict resolution rule.

In some embodiments, the dominant operation mode determining module includes a statistics module and a comparing and judging module, wherein, the statistics module is configured to perform statistics on the number or capacity of the indoor units corresponding to different target operation modes to serve as the heat exchange demands; and the comparing and judging module is configured to compare the heat exchange demands in different target operation modes to judge the dominant operation mode among the target operation modes.

In some embodiments, the indoor unit operation state determining module includes a conflict resolution module, configured to cause the indoor unit in which the target operation mode is inconsistent with the operation mode of the outdoor unit to enter a standby state; or cause the indoor unit in which the target operation mode is inconsistent with the operation mode of the outdoor unit to enter the same operation mode as the outdoor unit's; or when the indoor unit in which the target operation mode is inconsistent with the operation mode of the outdoor unit enter the same operation mode as the outdoor unit's, a low-energy heat exchange mode is adopt for operation.

According to a third aspect of the present disclosure, a heat pump multi-split is provided, including the system of controlling operation state of multi-split air conditioner in the above embodiment.

BRIEF DESCRIPTION OF THE DRAWINGS

The drawings described herein are used for providing a further understanding of the present disclosure and constitute a part of the present disclosure. Exemplary embodiments of the present disclosure and illustrations thereof are used for explaining the present disclosure, but constitute no improper limitation to the present disclosure. In the drawings.

DESCRIPTION OF THE INVENTION

The present disclosure is described in detail below. In the following paragraphs, different aspects of the embodiments are defined in more detail. Each aspect so defined may be combined with any other one or more aspects, unless clearly indicated as not being combinable. In particular, any feature that is considered to be preferred or advantageous may be combined with one or more other features that are considered to be preferred or advantageous.

The present disclosure provides a method of controlling operation state of multi-split air conditioner. A heat pump multi-split air conditioner includes at least one multi-split outdoor unit, at least two multi-split indoor units, and a wire controller for setting an operation mode of each indoor unit. The heat pump multi-split may operate a refrigeration mode or a heating mode, but the indoor unit cannot operate a mode that conflicts with the outdoor unit.

The present disclosure provides a method and system of controlling an operation state of a multi-split air conditioner, and a heat pump multi-split air conditioner, which can make the heat pump multi-split closer to the actual needs of most users in use.

Based on the above technical solutions, in the method of controlling operation state of multi-split air conditioner provided by the embodiment of the disclosure, the target operation mode of each indoor unit is determined according to the operation mode set by the user for the indoor unit, then statistics are performed on the heat exchange demands of the indoor units corresponding to different target operation modes to judge the dominant operation mode, and the dominant operation mode is determined as the operation mode of an outdoor unit. In this control method, when the operation mode of the outdoor unit is determined, the desired operation modes of users are quantitatively and comprehensively considered, so that the operation mode of the outdoor unit conforms to the actual indoor heat exchange demands of most users. In this way, the multi-split system is closer to the actual use demands of the most users, thereby improving the user experience, and being able to reduce user complaints when used in public places such as office buildings.

Figure 1:
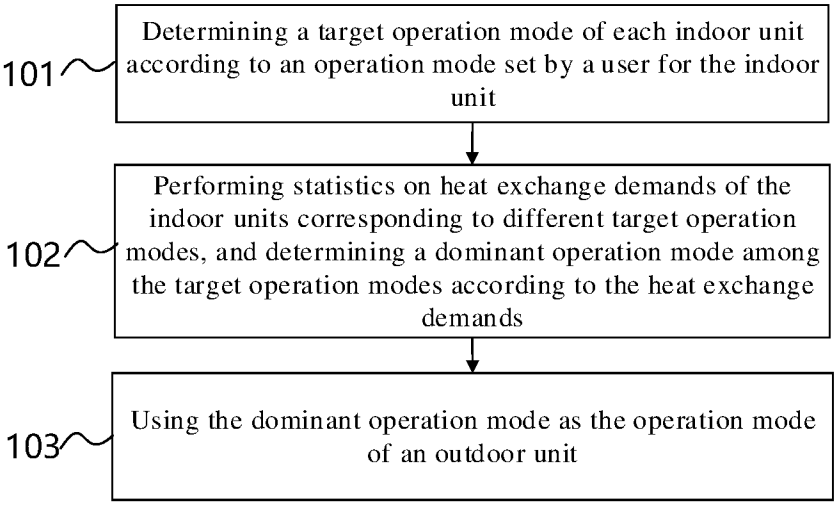
FIG. 1 is a schematic flow diagram of some embodiments of a method of controlling operation state of multi-split air conditioner of the present disclosure.

In some embodiments of the method of controlling operation state of multi-split air conditioner, the schematic flow diagram as shown in FIG. 1, includes:

Step 101: determining a target operation mode of each indoor unit according to an operation mode set by a user for the indoor unit;

Step 102: performing statistics on heat exchange demands of the indoor units corresponding to different target operation modes, and determining a dominant operation mode among the target operation modes according to the heat exchange demands; and Step 103: using the dominant operation mode as the operation mode of an outdoor unit, wherein the operation mode of the outdoor unit includes a refrigeration mode and a heating mode.

Step 101 to step 103 are performed sequentially. In the multi-split system, in some embodiments, the indoor unit and the outdoor unit are provided with a shared controller for centralized control, and the steps of the present disclosure can be performed by the controller. Alternatively, the indoor unit and the outdoor unit are provided with separate controllers, in this way, the step 101 is performed by the controller of the indoor unit, and the steps 102 and 103 are performed by the controller of the outdoor unit.

In step 101, the user uses the wire controller to set the operation mode of the indoor unit, for example, it may be a refrigeration mode, a heating mode, an air supply mode, a dehumidification mode, an automatic mode, and the like. After the indoor unit receives the set operation mode sent by the wire controller, the target operation mode of the indoor unit is judged and determined, for example, it may be the refrigeration mode, the heating mode or the air supply mode. The target operation mode is an operation mode that the indoor unit can support in the heat exchange mode. In the air supply mode, a heat exchanger does not participate in heat exchange.

In step 102, after the outdoor unit receiving the target operation modes sent by all indoor units, the outdoor unit performs statistics on the heat exchange demands of the indoor units corresponding to different target operation modes in a voting mode, for example, in all indoor units, according to the heat exchange demands of the indoor units corresponding to the refrigeration mode and the heating mode, the dominant operation mode is determined to determine the operation mode of the outdoor unit in step 103, the dominant operation mode is the operation mode with larger total heat exchange demands in all indoor units of the multi-split air conditioner. Then, the outdoor unit sends the determined operation mode to the indoor unit, so that the indoor unit judges its final operation state.

According to the control method in the present embodiment of the present disclosure, when the operation mode of the outdoor unit is determined, the desired operation modes of users are quantitatively and comprehensively considered, so that the operation mode of the outdoor unit conforms to the actual indoor heat exchange demands of most users, in this way, the control mode is closer to the actual use demands of the most users, thereby improving the user experience, and being able to reduce user complaints when used in public places such as office buildings.

Figure 2:
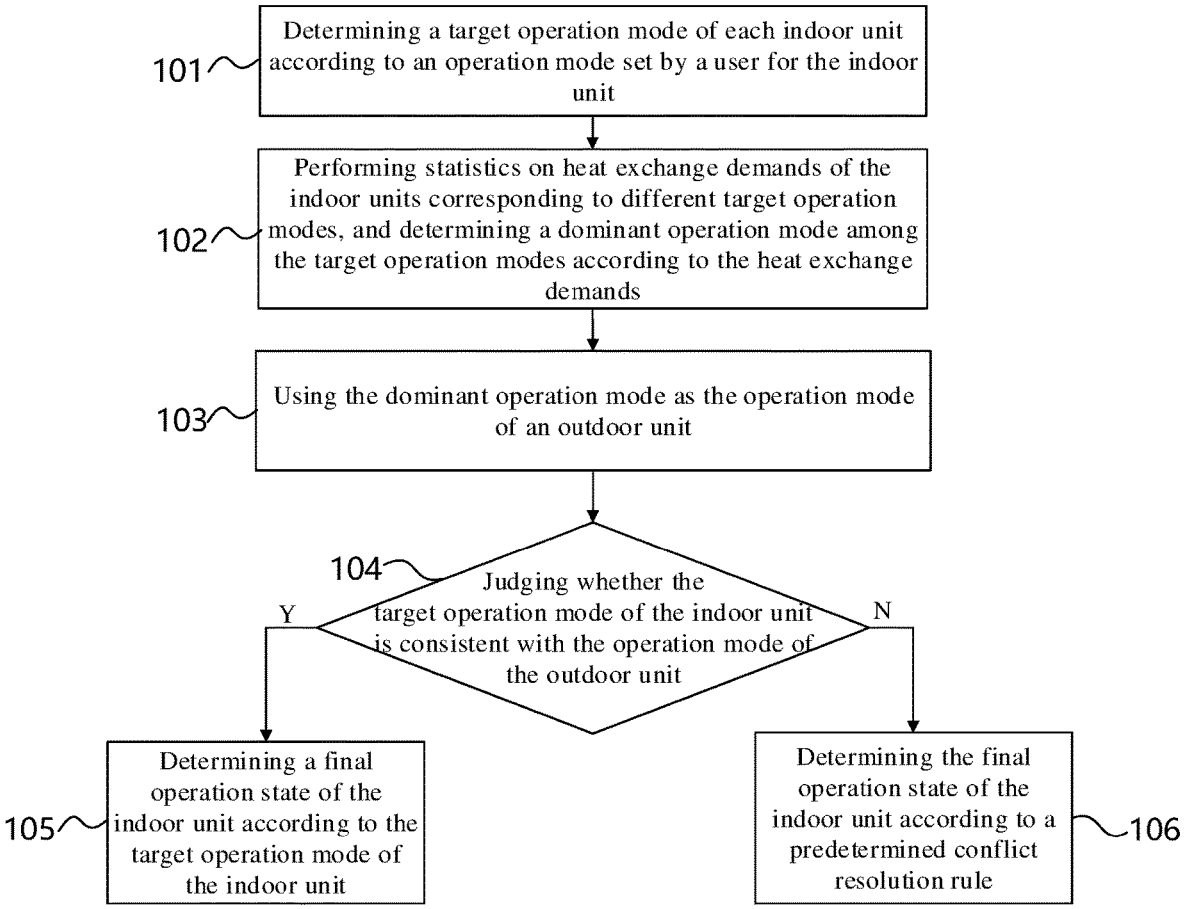
FIG. 2 is a schematic flow diagram of other embodiments of the method of controlling operation state of multi-split air conditioner of the present disclosure.

In other embodiments of the present disclosure, in the schematic flow diagram as shown in FIG. 2, after the operation mode of the outdoor unit is determined, the control method further includes:

Step 104: judging whether the target operation mode of the indoor unit is consistent with the operation mode of the outdoor unit, and if they are consistent, executing step 105, or else executing step 106;

Step 105: determining a final operation state of the indoor unit according to the target operation mode of the indoor unit; wherein the final operation state of the indoor unit may be refrigeration mode operation, heating mode operation, refrigeration mode standby and heating mode standby; and Step 106: determining the final operation state of the indoor unit according to a predetermined conflict resolution rule. There will be a conflict between the refrigeration mode and the heating mode, and the air supply mode generates no conflict with the refrigeration mode and the heating mode.

In the present embodiment, the multi-split system may automatically determine the final operation state of the indoor unit according to the operation mode of the outdoor unit, for the indoor unit in which the target operation mode is consistent with the operation mode of the outdoor unit, it may directly work in the set target operation mode according to user demands, and since the operation mode of the outdoor unit is determined according to most user demands, the final determined operation states of most indoor units are consistent with the set target operation mode.

For the indoor unit in which the target operation mode is inconsistent with the operation mode of the outdoor unit, the heat exchange demands of these few users are different from those of the most users. Since the indoor unit of the heat pump multi-split cannot adopt the operation mode that conflicts with the outdoor unit, the final operation state of the indoor unit is determined according to the predetermined conflict resolution rule, so that abnormal multi-split operation due to user selection mode conflicts or maloperations may be avoided, and the multi-split work reliability is improved. When the indoor unit and the outdoor unit are provided with separate controllers, steps 104 to 106 may be executed by the controller of the indoor unit.

Various steps in the above main flow will be explained in detail below.

In the step 101, the step of determining the target operation modes of each indoor unit according to the operation mode set by the user for the indoor unit specifically includes at least one of the following steps:

if the operation mode set for the indoor unit is a refrigeration mode or a dehumidification mode, determining the target operation mode of the indoor unit as the refrigeration mode;

if the operation mode set for the indoor unit is a heating mode, determining the target operation mode of the indoor unit as the heating mode;

if the operation mode set for the indoor unit is an air supply mode, determining the target operation mode of the indoor unit as the air supply mode; and/or if the operation mode set for the indoor unit is an automatic mode, determining the target operation mode of the indoor unit according to a current environment temperature and a temperature range in the automatic mode set by the user.

In some embodiments, if the operation mode set for the indoor unit is the automatic mode, the step of determining the target operation mode of the indoor unit according to the current environment temperature and the temperature range in the automatic mode set by the user includes at least one of the following steps:

judging a relationship between the current environment temperature and the temperature range, and if the current environment temperature is greater than an upper limit of the temperature range, determining the target operation mode of the indoor unit as the refrigeration mode;

if the current environment temperature is less than the upper limit of the temperature range, determining the target operation mode of the indoor unit as the heating mode; and if the current environment temperature is within the temperature range, maintaining the target operation mode of the indoor unit as the previous target operation mode within the temperature range, or performing processing according to a preset default mode when entering the temperature range for the first time. The default mode may be the refrigeration mode or the heating mode, which may be determined according to actual demands.

In some embodiments, in step 102, taking it as an example that the indoor unit and the outdoor unit are provided with a controller respectively, the step of performing statistics on heat exchange demands of the indoor units corresponding to different target operation modes, specifically includes:

sending the target operation mode information of each indoor unit to the controller of the outdoor unit by the controller of the indoor unit; and performing statistics on the number or capacity of the indoor units corresponding to different target operation modes by the controller of the outdoor unit, so as to serve as the heat exchange demands of the indoor units corresponding to different target operation modes.

In order to avoid frequent changes in the operation mode of the whole machine, the heat exchange demands of the indoor units corresponding to different target operation modes are determined after every period of time, the interval time may be 10 min, 20 min, 30 min and the like, and 20 min is preferred herein.

The two judgment modes are explained below respectively:

(1) Determining the operation mode of the outdoor unit based on the number of indoor units:

Firstly, calculating is respectively performed on the numbers of indoor units in which the target operation modes are the refrigeration mode and the heating modes; and the statistical information includes the total number of indoor units, the total number of indoor units in the refrigeration mode, and the total number of indoor units in the heating mode.

Next, the total numbers of corresponding indoor units in which the target operation modes are the refrigeration mode and the heating mode are compared, if the total number of indoor units in the refrigeration mode is greater than the total number of indoor units in the heating mode, then the dominant operation modes in the indoor units are the refrigeration mode; if the total number of indoor units in the refrigeration mode is less than the total number of indoor units in the heating mode, then the dominant operation modes in the indoor units are the heating mode; if the total number of indoor units in the refrigeration mode is equal to the total number of indoor units in the heating mode, then the dominant operation modes in the indoor units remain unchanged, that is, the operation mode of the outdoor unit remains unchanged, or when the dominant operation mode is determined for the first time, processing is performed according to the default mode. The default mode may be the refrigeration mode or the heating mode, which may be determined according to actual demands.

(2) Determining the operation mode of the outdoor unit according to the capacity of the indoor units:

Firstly, statistics is respectively performed on the capacity of the corresponding indoor units in which the target operation modes are the refrigeration mode and the heating mode; the statistical information includes the rated capacity of the indoor units, the total capacity of the indoor units in the refrigeration mode, and the total capacity of the indoor units in the heating mode.

Next, the total capacities of the indoor units in which the target operation modes are the refrigeration mode and the heating mode are compared, if the total capacity of the indoor units in the refrigeration mode is greater than the total capacity of the indoor units in the heating mode, then the dominant operation modes in the indoor units are the refrigeration mode; if the total capacity of the indoor units in the refrigeration mode is less than the total capacity of the indoor units in the heating mode, then the dominant operation modes in the indoor units are the heating mode; and if the total capacity of the indoor units in the refrigeration mode is equal to the total capacity of the indoor units in the heating mode, then the dominant operation modes in the indoor units remain unchanged, that is, the operation mode of the outdoor unit remains unchanged, or when the dominant operation mode is determined for the first time, processing is performed according to the default mode. The default mode may be the refrigeration mode or the heating mode, which may be determined according to actual demands.

When it is judged in step 104 that the target operation mode of the indoor unit is inconsistent with the operation mode of the outdoor unit, in the first way to resolve the conflict of the operation modes, step 106 of determining the final operation state of the indoor unit according to the predetermined conflict resolution rule includes:

causing the indoor unit in which the target operation mode is inconsistent with the operation mode of the outdoor unit to enter a standby mode.

In this control mode, in the case of a conflict between the operation mode of the indoor unit and the operation mode of the outdoor unit, unnecessary operation energy consumption of the indoor unit may be reduced, a better energy conservation effect is achieved, and meanwhile, abnormal multi-split operation due to user selection mode conflicts or maloperations may also be avoided. Under this predetermined conflict resolution rule, the final operation state of the indoor unit is determined as follows:

if the target operation mode of the indoor unit is the air supply mode, then the final operation state of the indoor unit is the air supply mode;

if the target operation mode of the indoor unit is the refrigeration mode, and the operation mode of the outdoor unit is the refrigeration mode, then the final operation state of the indoor unit is the refrigeration mode;

if the target operation mode of the indoor unit is the refrigeration mode, and the operation mode of the outdoor unit is the heating mode, then the final operation state of the indoor unit is refrigeration mode standby;

if the target operation mode of the indoor unit is the heating mode, and the operation mode of outdoor unit is the refrigeration mode, then the final operation state of the indoor unit is heating mode standby; and if the target operation mode of the indoor unit is the heating mode, and the operation mode of outdoor unit is the heating mode, then the final operation state of the indoor unit is the heating mode.

In the second way to resolve the conflict of the operation modes, step 106 of determining the final operation state of the indoor unit according to the predetermined conflict resolution rule, includes:

causing the indoor unit in which the target operation mode is inconsistent with the operation mode of the outdoor unit to take the operation mode of the outdoor unit.

Because the indoor unit of the heat pump multi-split cannot adopt the operation mode that conflicts with the outdoor unit, so this control mode forces the indoor unit in which the target operation mode is inconsistent with the operation mode of the outdoor unit to work according to the operation mode of the outdoor unit, in this way, the abnormal multi-split operation due to user selection mode conflicts or maloperations may be avoided, and the multi-split working reliability is improved.

Base on the second way to resolve the conflict of the operation modes, it may be more preferentially performed according to a third way to resolve the conflict of the operation modes, and step 106 of determining the final operation state of the indoor unit according to the predetermined conflict resolution rule includes:

when the indoor unit in which the target operation mode is inconsistent with the operation mode of the outdoor unit takes the operation mode of the outdoor unit, adopting a low-energy heat exchange mode for operation.

In the low-energy heat exchange mode, the indoor unit reduces the heat exchange capacity to work, so that the impact on the room temperature when the indoor unit runs in a conflict mode can be reduced, and the user experience is improved. Compared with the first way, the problem that the unit does not run after the user turns on the unit, such that the user thinks that the unit is faulty can be avoided, the set temperature of the user is not changed, although the final operation state of this indoor unit is different from the originally set operation mode, when the indoor unit works in the operation mode that matches the outdoor unit, temperature adjustment is also performed with the temperature set by the user as the target, if the indoor temperature changes to the need for heat exchange by the unit, the indoor temperature may also be adjusted, and the user experience may be improved.

The low-energy heat exchange mode includes a low-energy refrigeration mode and a low-energy heating mode. In the low-energy refrigeration mode, a draught fan of the indoor unit operates at a low wind speed, the lowest wind speed is preferentially selected, and a target degree of superheat controlled by an electronic expansion valve of the indoor unit is increased by a first preset temperature value (a° C.) compared with that of a normal refrigeration mode. In the low-energy heating mode, the draught fan of the indoor unit operates at the low wind speed, the lowest wind speed is preferentially selected, and the target degree of supercooling controlled by the electronic expansion valve of the indoor unit is increased by a second preset temperature value (b° C.) compared with that of a normal heating mode. The values a and b are 1/2/3 and other natural numbers, which are determined based on experience. For example, in the refrigeration mode, the target degree of superheat controlled by the electronic expansion valve of the indoor unit is adjusted to reduce the amount of liquefaction of a gaseous refrigerant, thereby reducing the turn volume of the effective refrigerant, reducing the refrigerating capacity of the indoor unit, reducing the working gear of the draught fan to reduce the speed of air entering indoors after heat exchange, and reducing the impact on the room temperature in the case of a conflict between the operation modes of the indoor unit and the outdoor unit.

The capacity output of the outdoor unit of the multi-split system changes in real time according to the startup, shutdown, shutdown to a temperature point, failure shutdown and other conditions of the indoor unit in the system, that is, a part of capacity output of the outdoor unit is correspondingly increased when one more indoor unit in the system is opened. The indoor unit running in the low-energy heat exchange mode performs judgement according to the set temperature and room temperature, if there is a capacity demand, the outdoor unit calculates the specific capacity demands of this indoor unit, and then adjust the total capacity output of the outdoor unit.

In the low-energy heat exchange mode, the outdoor unit needs to multiply the normal heat exchange capacity of the indoor unit by a preset coefficient m when calculating the current heat exchange capacity demand of the indoor unit, wherein $0<m<1$, m is determined based on experience, such as 0.6/0.7/0.8.

In some embodiments, in the low-energy heat exchange mode, the indoor unit performs adjustment with the set temperature of the user as the target. When the indoor unit works in the low-energy heat exchange mode, the set temperature of the user is not changed. Although the final operation state of this indoor unit is different from the originally set operation mode, when the indoor unit works in the operation mode that matches the outdoor unit, air conditioning is also performed with the set temperature of the user as the target.

For example, if the outdoor unit operates the heating mode, the user sets the indoor unit as the refrigeration mode, the set temperature is 24° C., at this time, if the room temperature is 26° C., then the indoor unit may operate in the low-energy heating mode. During the operation, although the user sets refrigeration at 24° C., the multi-split system stills performs control according to heating 24° C. That is, although the operation mode of the indoor unit is different from the expectation of the user, the target control temperature remains at the set temperature of the user.

Specifically, when the indoor unit enters the low-energy operation mode, a temperature difference is judged at first, and since the set temperature 24° C. is less than the room temperature 26° C., the indoor unit does not operate at this time. If the room temperature drops to 23 ° C. due to people moving or the doors and windows are opened for air circulation, then the set temperature 24° C. is greater than the room temperature 23° C., at this time, the indoor unit has heating capacity demand, and the indoor unit enters the low-energy heating mode.

In the multi-split system, only one of the three ways to resolve the conflict of the operation modes, and multiple ways may also be provided, and the user can select one for use as needed. For example, the first mode is used as the factory default setting, and when the user uses it, any one of ways can be selected according to actual use occasions and use population.

In some embodiments, in the method of controlling operation state of multi-split air conditioner, the target operation mode of the indoor unit has a preset memory time, the memory time may be 10 min, 15 min, 30 min and the like, and preferably 15 min herein. After exceeding the preset memory time, the target operation mode of the indoor unit is replaced with the operation mode of the outdoor unit.

By setting the preset memory time, the desired operation mode of the indoor unit of the user may be retained for a period of time, the advantage is that when the target operation mode of the indoor unit conflicts with the operation mode of the outdoor unit, although the current indoor unit does not work according to the expected operation mode, however, if the operation mode of the outdoor unit changes within the memory time, the indoor unit may also work in a normal energy consumption heat exchange mode according to the memorized target operation mode, so as to be as close as possible to the actual use demand of the user and to optimize the user experience.

Within the preset memory time, if the user resets the operation mode of the indoor unit, the indoor unit re-determines the target operation mode and re-accumulates the preset memory time starting from the reset moment. In this way, each time the user resets the operation mode of the indoor unit, the latest desired operation mode of the user may be retained for the preset memory time.

Within the preset memory time, if the target operation mode of the indoor unit is consistent with the operation mode of the outdoor unit, the indoor unit adopts the target operation mode; if the target operation mode of the indoor unit conflicts with the actual operation mode, the indoor unit changes to work according to the operation mode of the outdoor unit in the low-energy heat exchange mode, for example, operate according to the low-energy refrigeration mode or the low-energy heating mode, so as to reduce the impact of the operation mode conflict on the indoor temperature.

A specific example is given below. In the multi-split system, it is assumed that the user sets the operation mode of one indoor unit as the refrigeration mode, the target operation mode judged by the indoor unit is also the refrigeration mode, it is determined that the operation mode of the outdoor unit is the heating mode by performing statistics on the number of indoor units corresponding to the heating mode and the refrigeration mode, then the indoor unit may be forced to operate in the low-energy heating mode.

Moreover, the preset memory time of the target operation mode of the indoor unit is set as 30 min, and within the time, the memorized target operation mode is the refrigeration mode. If the operation mode of the outdoor unit changes to the refrigeration mode within 30 min, the indoor unit operates in the normal refrigeration mode. If the operation mode of the outdoor unit is always the heating mode within 30 min, the indoor unit operates according to the low-energy heating mode, and the target operation mode of the indoor unit is changed into the operation mode of the outdoor unit, that is, the heating mode 30 min later. During the operation of the indoor unit in the low-energy heating mode, the outdoor unit calculates the current heating capacity demand of the indoor unit to be 0.8 of that during the operation in the normal heating mode (the preset coefficient m is preferably 0.8 herein), the indoor unit is force to operate at the low wind speed, and the target degree of supercooling controlled by an electronic expansion valve is 3° C. higher than that in the normal heating mode (b is preferably 3 herein).

Secondly, the present disclosure further provides a system of controlling operation state of multi-split air conditioner, in some embodiments, including:

a target operation mode determining module, configured to determine a target operation mode of each indoor unit according to an operation mode set by a user for the indoor unit;

a dominant operation mode determining module, configured to perform statistics on heat exchange demands of the indoor units corresponding to different target operation modes, and determine a dominant operation mode among the target operation modes according to the heat exchange demands; and an outdoor unit operation mode determining module, configured to determine the dominant operation mode determined by the dominant operation mode determining module as the operation mode of an outdoor unit.

According to the control system, when the operation mode of the outdoor unit is determined, the desired operation modes of users are quantitatively and comprehensively considered, so that the operation mode of the outdoor unit conforms to the actual indoor heat exchange demands of most users, in this way, the multi-split system is closer to the actual use demands of the most users, thereby improving the user experience, and being able to reduce user complaints when used in public places such as office buildings.

Specifically, the dominant operation mode determining module includes a statistics module and a comparing and judging module. The statistics module is configured to perform statistics on the number or capacity of the indoor units corresponding to different target operation modes to serve as the heat exchange demands; and the comparing and judging module is configured to compare the heat exchange demands in different target operation modes to judge the dominant operation mode among the target operation modes.

On this basis, the control system of the present disclosure further includes an indoor unit operation state determining module, configured to judge whether the target operation mode of the indoor unit determined by the target operation mode determining module is consistent with the operation mode of the outdoor unit determined by the outdoor unit operation mode determining module, if they are consistent, determine a final operation state of the indoor unit according to the target operation mode of the indoor unit, or else determine the final operation state of the indoor unit according to a predetermined conflict resolution rule.

Because the indoor unit of the heat pump multi-split cannot adopt the operation mode that conflicts with the outdoor unit, so the final operation state of the indoor unit may be determined according to the predetermined conflict resolution rule in the present embodiment, so as to avoid abnormal multi-split operation due to user selection mode conflicts or maloperations and to improve the multi-split working reliability.

In some embodiments, the indoor unit operation state determining module includes a conflict resolution module, configured to cause the indoor unit in which the target operation mode is inconsistent with the operation mode of the outdoor unit to enter a standby state; or, cause the indoor unit in which the target operation mode is inconsistent with the operation mode of the outdoor unit to take the operation mode of the outdoor unit; or, when the indoor unit in which the target operation mode is inconsistent with the operation mode of the outdoor unit takes the operation mode of the outdoor unit, adopts a low-energy heat exchange mode for operation.

The contents of specifically determining the operation mode of the outdoor unit and resolving the conflict of the operation modes have been described in detail in the control method section, and the subject of the control system may refer to the previous description.

Finally, the present disclosure further provides a multi-split system, for example a heat pump multi-split, including the system of controlling operation state of multi-split air conditioner described in the above embodiments. According to the multi-split system, when the operation mode of the outdoor unit is determined, the desired operation modes of users are quantitatively and comprehensively considered, so that the operation mode of the outdoor unit conforms to the actual indoor heat exchange demands of most users. In this way, the multi-split system is closer to the actual use demands of the most users, thereby improving the user experience, and being able to reduce user complaints when used in public places such as office buildings. In some embodiments, because the indoor unit of the heat pump multi-split cannot adopt the operation mode that conflicts with the outdoor unit, by setting the conflict resolution rule, the indoor unit may automatically select a proper operation state, abnormal multi-split operation due to user selection mode conflicts or maloperations may be avoided, and the multi-split working reliability is improved. In addition, in the case of conflict of the operation state, the indoor unit adopts the operation mode of the outdoor unit, and meanwhile, the impact of the mode conflict on the indoor temperature may be reduced as much as possible by adopting the low-energy operation mode, so that the multi-split system has better user experience.

The method and system of controlling operation state of multi-split air conditioner, and the heat pump multi-split air conditioner provided by the present disclosure have been described in detail above. Specific embodiments are used herein to explain the principles and implementations of the present disclosure. The description of the above embodiments is only used to help understand the method of the present disclosure and its core ideas. It should be noted that, for those of ordinary skill in the art, without departing from the principle of the present disclosure, several improvements and modifications may be made to the present disclosure, and these improvements and modifications also fall within the protection scope of the claims of the present disclosure.

The solutions provided by the embodiments of the present disclosures may be applied to a multi-split operation state control process. In the embodiments of the present disclosure, the target operation mode of each indoor unit is determined according to the operation mode set by the user for the indoor unit, statistics is performed on the heat exchange demands of the indoor units corresponding to different target operation modes to judge the dominant operation mode, and the dominant operation mode is determined as the operation mode of the outdoor unit. In this control method, when the operation mode of the outdoor unit is determined, the desired operation modes of users are quantitatively and comprehensively considered, so that the operation mode of the outdoor unit conforms to the actual indoor heat exchange demands of most users, in this way, the multi-split system is closer to the actual use demands of the most users, thereby improving the user experience, and being able to reduce user complaints when used in public places such as office buildings.

The invention claimed is:

1. A method of controlling an operation state of multi-split air conditioner, comprising:

determining a target operation mode of each indoor unit according to an operation mode set by a user for each indoor unit;

performing statistics on heat exchange demands of the indoor units corresponding to different target operation modes, and determining a dominant operation mode among the target operation modes according to the heat exchange demands; and using the dominant operation mode as the operation mode of an outdoor unit;

wherein the step of performing statistics on heat exchange demands of the indoor units corresponding to different target operation modes, and determining the dominant operation mode among the target operation modes according to the heat exchange demands specifically comprises;

performing statistics on heat exchange demand of the indoor units having a refrigeration mode as the target operation mode and heat exchange demand of the indoor units having a heating mode as the target operation mode; and comparing the heat exchange demand of the indoor units having the refrigeration mode as the target operation mode and the heat exchange demand of the indoor units having the heating mode as the target operation mode, and if the heat exchange demand of the indoor units in the refrigeration mode is greater than the heat exchange demand of the indoor units in the heating mode, determining the dominant operation mode of each indoor unit as the heating mode; if the heat exchange demand of the indoor units in the refrigeration mode is less that the heat exchange demand of the indoor units in the heating mode, determining the dominant operation mode of each indoor unit as the heating mode; and if the heat exchange demand of the indoor units in the refrigeration mode is equal to the heat exchange demand of the indoor units in the heating mode, maintaining the dominant operation mode of each indoor unit unchanged, or performing processing according to a default mode when the dominant operation mode is determined for a first time.

2. The method of controlling an operation state of multi-split air conditioner according to claim 1, wherein after determining the operation mode of the outdoor unit, the control method further comprises:

judging whether the target operation mode of an indoor unit is consistent with the operation mode of the outdoor unit, if yes, determining a final operation state of the indoor unit according to the target operation mode of the indoor unit, if no, determining the final operation state of the indoor unit according to a predetermined conflict resolution rule.

3. The method of controlling an operation state of multi-split air conditioner according to claim 1, wherein the step of determining the target operation mode of each indoor unit according to the operation mode set by the user for the indoor unit comprises at least one of the following steps:

if the operation mode set for the indoor unit is the refrigeration mode or a dehumidification mode, determining the target operation mode of the indoor unit as the refrigeration mode;

if the operation mode set for the indoor unit is the heating mode, determining the target operation mode of the indoor unit as the heating mode;

if the operation mode set for the indoor unit is an air supply mode, determining the target operation mode of the indoor unit as the air supply mode; and if the operation mode set for the indoor unit is an automatic mode, determining the target operation mode of the indoor unit according to a current environment temperature and a temperature range in the automatic mode set by the user.

4. The method of controlling an operation state of multi-split air conditioner according to claim 3, wherein if the operation mode set for the indoor unit is the automatic mode, the step of determining the target operation mode of the indoor unit according to the current environment temperature and the temperature range in the automatic mode set by the user comprises at least one of the following steps:

if the current environment temperature is greater than an upper limit of the temperature range, determining the target operation mode of the indoor unit as the refrigeration mode;

if the current environment temperature is less than the upper limit of the temperature range, determining the target operation mode of the indoor unit as the heating mode; and if the current environment temperature is within the temperature range, maintaining the target operation mode of the indoor unit as the previous target operation mode within the temperature range, or performing processing according to a default mode when entering the temperature range for a first time.

5. The method of controlling an operation state of multi-split air conditioner according to claim 1, wherein the step of performing statistics on heat exchange demands of the indoor units corresponding to different target operation modes specifically comprises:

performing statistics on a number or a capacity of the indoor units corresponding to different target operation modes to serve as the heat exchange demands.

6. The method of controlling an operation state of multi-split air conditioner according to claim 2, wherein the step of determining the final operation state of the indoor unit according to the predetermined conflict resolution rule, comprises: causing the indoor unit in which the target operation mode is inconsistent with the operation mode of the outdoor unit to enter a standby mode.

7. The method of controlling an operation state of multi-split air conditioner according to claim 2, wherein the step of determining the final operation state of the indoor unit according to the predetermined conflict resolution rule comprises:

causing the indoor unit in which the target operation mode is inconsistent with the operation mode of the outdoor unit to enter the same operation mode as the outdoor unit.

8. The method of controlling an operation state of multi-split air conditioner according to claim 7, wherein when the indoor unit in which the target operation mode is inconsistent with the operation mode of the outdoor unit enter the same operation mode as the outdoor unit, a low-energy heat exchange mode is adopted for operation.

9. The method of controlling an operation state of multi-split air conditioner according to claim 8, wherein the low-energy heat exchange mode comprises:

a low-energy refrigeration mode: a draught fan of the indoor unit operates at a low wind speed, and a target degree of superheat controlled by an electronic expansion valve of the indoor unit is increased by a first preset temperature value compared with that of a normal refrigeration mode; or a low-energy heating mode: the draught fan of the indoor unit operates at the low wind speed, and a target degree of supercooling controlled by the electronic expansion valve of the indoor unit is increased by a second preset temperature value compared with that of a normal heating mode.

10. The method of controlling an operation state of multi-split air conditioner according to claim 8, wherein in the low-energy heat exchange mode, when the outdoor unit calculates a heat exchange capacity demand of the current indoor unit, a preset coefficient m is multiplied by the normal heat exchange capacity of the indoor unit, wherein $0<m<1$.

11. The method of controlling an operation state of multi-split air conditioner according to claim 8, wherein in the low-energy heat exchange mode, the indoor unit is adjusted with a temperature set by the user as a target.

12. The method of controlling an operation state of multi-split air conditioner according to claim 6, wherein the target operation mode of the indoor unit has a preset memory time, and after exceeding the preset memory time, the target operation mode of the indoor unit is replaced with the operation mode of the outdoor unit.

13. The method of controlling an operation state of multi-split air conditioner according to claim 12, wherein within the preset memory time, if the user resets the operation mode of the indoor unit, the indoor unit re-determines the target operation mode, and accumulates the preset memory time again starting from the reset moment.

14. The method of controlling an operation state of multi-split air conditioner according to claim 12, wherein within the preset memory time, if the target operation mode of the indoor unit is consistent with the operation mode of the outdoor unit, the indoor unit adopts the target operation mode, and if the target operation mode of the indoor unit is inconsistent with the operation mode of the outdoor unit, the indoor unit works according to the operation mode of the outdoor unit in a low-energy heat exchange mode.

15. A system of controlling an operation state of multi-split air conditioner, comprising:

a target operation mode determining module, configured to determine a target operation mode of each indoor unit according to an operation mode set by a user for the indoor unit;

a dominant operation mode determining module, configured to perform statistics on heat exchange demands of the indoor units corresponding to different target operation modes, and determine a dominant operation mode among the target operation modes according to the heat exchange demands; and an outdoor unit operation mode determining module, configured to determine the dominant operation mode determined by the dominant operation mode determining module as the operation mode of an outdoor unit;

wherein the dominant operation mode determining module is configured to perform statistics on the heat exchange demand of the indoor units having a refrigeration mode as the target operation mode and heat exchange demand of the indoor units having a heating mode as the target operation mode; and compare the heat exchange demand of the indoor units having the refrigeration mode as the target operation mode and the heat exchange demand of the indoor units having the heating mode as the target operation mode, and if the heat exchange demand of the indoor units in the refrigeration mode is greater than the heat exchange demand of the indoor units in the heating mode, determining the dominant operation mode of each indoor unit as the heating mode; if the heat exchange demand of the indoor units in the refrigeration mode is less than the heat exchange demand of the indoor units in the heating mode, determining the dominant operation mode of each indoor unit as the heating mode; and if the heat exchange demand of the indoor units in the refrigeration mode is equal to the heat exchange demand of the indoor units in the heating mode, maintaining the dominant operation mode of each indoor unit unchanged, or performing processing according to a default mode when the dominant operation mode is determined for the first time.

16. The system of controlling an operation state of multi-split air conditioner according to claim 15, further comprising an indoor unit operation state determining module, configured to judge whether the target operation mode of the indoor unit determined by the target operation mode determining module is consistent with the operation mode of the outdoor unit determined by the outdoor unit operation mode determining module, if yes, determine a final operation state of the indoor unit according to the target operation mode of the indoor unit, if no, determine the final operation state of the indoor unit according to a predetermined conflict resolution rule.

17. The system of controlling an operation state of multi-split air conditioner according to claim 15, wherein the dominant operation mode determining module comprises a statistics module and a comparing and judging module, wherein, the statistics module is configured to perform statistics on a number or a capacity of the indoor units corresponding to different target operation modes to serve as the heat exchange demands; and the comparing and judging module is configured to compare the heat exchange demands in different target operation modes to judge the dominant operation mode among the target operation modes.

18. The system of controlling an operation state of multi-split air conditioner according to claim 16, wherein the indoor unit operation state determining module comprises a conflict resolution module, configured to cause the indoor unit in which the target operation mode is inconsistent with the operation mode of the outdoor unit to enter a standby state; or cause the indoor unit in which the target operation mode is inconsistent with the operation mode of the outdoor unit to enter the same operation mode as the outdoor unit's; or when the indoor unit in which the target operation mode is inconsistent with the operation mode of the outdoor unit enter the same operation mode as the outdoor unit's, a low-energy heat exchange mode is adopt for operation.

19. A heat pump multi-split air conditioner, comprising the system of controlling an operation state of multi-split air conditioner of claim 15.

* * * * *